United States Patent [19]

Hall et al.

[11] Patent Number: 4,919,063

[45] Date of Patent: Apr. 24, 1990

[54] HULL CONSTRUCTION FOR A SWATH VESSEL

[75] Inventors: Nelson W. Hall, Poway; Paul Kotzebue, San Diego, both of Calif.

[73] Assignee: Swath Ocean Systems, Inc., Rancho Santa Fe, Calif.

[21] Appl. No.: 318,263

[22] Filed: Mar. 7, 1989

Related U.S. Application Data

[63] Continuation-in-part of Ser. No. 174,286, Mar. 28, 1988, abandoned.

[51] Int. Cl.[5] ..... B63B 1/10

[52] U.S. Cl. ..... 114/56; 114/61; 114/274

[58] Field of Search ..... 114/56, 57, 61, 123, 114/355, 274

[56] References Cited

U.S. PATENT DOCUMENTS

| | | | |
|---|---|---|---|
| 3,447,502 | 6/1969 | Leopold | 114/61 |
| 3,470,839 | 10/1969 | Faul et al. | 114/61 |
| 3,885,514 | 5/1975 | Lauenborg | 114/61 |
| 4,174,671 | 11/1979 | Seidl | 114/61 |
| 4,702,189 | 10/1987 | Schlichthorst | 114/61 |
| 4,708,077 | 11/1987 | Balquet et al. | 114/61 |

FOREIGN PATENT DOCUMENTS

| | | | |
|---|---|---|---|
| 2058678 | 4/1981 | United Kingdom | 114/61 |

*Primary Examiner*—Sherman D. Basinger
*Assistant Examiner*—Stephen P. Avila
*Attorney, Agent, or Firm*—Charles E. Townsend, Jr.

[57] ABSTRACT

An improved hull construction for a SWATH vessel of the type having first and second pontoons disposed beneath a superstructure and coupled thereto by vertically disposed struts. The improvement comprises substantially hollow sponson whose bottom surface defines a relatively narrow horizontally extending strake disposed between the superstructure and each pontoon for producing forces to right the vessel including substantially instantaneously increasing the rate of buoyancy as the superstructure contacts the water surface. In the preferred embodiment, each sponson extends fore and art of the vessel for substantially the entire length of the struts, and includes a bottom surface defining a strake located a prescribed distance below the superstructure for increasing the waterplane area by a prescribed amount when the bottom surfaces of the sponsons contact the water's surface. The bottom surfaces of the sponsons are located so that the vessel is substantially prevented from rolling by more than a first prescribed angle, and from pitching by more than a second prescribed angle from horizontal.

54 Claims, 3 Drawing Sheets

HULL CONSTRUCTION FOR A SWATH VESSEL

BACKGROUND OF THE INVENTION

This application is a continuation-in-part of my copending application Ser. No. 07/174,286, filed Mar. 28, 1988 now abandoned.

FIELD OF THE INVENTION

This invention relates to a new and improved SWATH type vessel and, more particularly, to a new and improved hull construction for such vessel.

DESCRIPTION OF THE RELEVANT ART

The term "SWATH" is an acronym for Small Waterplane Area Twin Hull. Conceptually, SWATH vessels date back at least 50 years and are characterized generally as comprising two submerged, parallel, torpedo-like pontoons, each of which is provided with one or more vertical struts which project upwardly a substantial distance above the water line and which at their upper ends support the above-water superstructure of the vessel. As used herein, the superstructure of the vessel includes all parts of the vessel above the wet-deck, and it includes the portion of the vessel between the wet-deck and the weather-deck. The combined buoyancy of the two (or more) pontoons is sufficient to support the superstructure of the vessel a predetermined distance (e.g., 5–8 feet) above water level while the boat is at rest, as well as when it is under way in relatively calm waters. It is well known to provide SWATH vessels with underwater horizontal stabilizers or canards to assist in maintaining stability of the boat in terms of pitch, roll, or yaw while moving at medium to higher speeds through calm or rough waters.

The above-water superstructure of a SWATH may be designed and outfitted to function substantially the same as a conventional mono-hull boat or ship, and either primarily as a cargo or passenger-carrying vessel. During more recent years, a number of SWATH vessels, ranging in length from approximately 60 feet to over 200 feet, have been built and tested or operated as ocean or seagoing vessels with reasonable success.

To our present knowledge, all of the reasonably well designed SWATHs that have been built and operated within the past decade provide much enhanced riding stability over any known conventional hull or catamaran construction. A properly designed SWATH inherently provides a much more "level" ride as far as minimizing the amount of pitch and roll inherent in more conventional designs. However, one severe shortcoming that has been encountered in SWATH vessels of which we have knowledge is that when the vessel encounters even moderately rough head seas (e.g., as little as 10-ft. seas), the bow of the SWATH structure tends to plough into or abruptly land atop the head seas, resulting in the bottom or "wet-deck" of the superstructure forcefully "slamming" against the oncoming waves and/or creating the danger of swamping and sinking the boat. In any event, the impact with the head seas violently and abruptly alters the movement of the vessel (e.g., the vessel immediately brakes or stalls), and this can cause serious injury to passengers or cargo on board.

SUMMARY OF THE INVENTION

An object of the present invention is to provide a SWATH-type vessel that is uniquely designed and constructed for maintaining the wet deck of the main superstructure spaced above the underlying water surface, virtually regardless of the size or magnitude of the wave action, and regardless of the relative direction of movement of the vessel with respect to the direction of travel of the waves.

A more specific object of the invention is to design and construct a SWATH vessel which incorporates a unique reserve buoyancy system in the form of strake and novel reserve buoyancy sponsons, located between the wet deck of the main superstructure and the underwater pontoons. In one embodiment of the invention, the reserve buoyancy sponsons are formed in the shape of a truncated "V," when viewed in transverse cross-section, and they extend continuously fore and aft for substantially the full length of the pontoons and the wet deck of the main superstructure. The bottom surfaces of the elongated sponsons provide, relatively speaking, long, sleek, water-ski type strakes. Each horizontal strake in conjunction with its associated strut and sponson, and depending on the configuration and downward angularity of the laterally projecting inboard and outboard surfaces of the strake, performs multiple functions to minimize slamming and heeling of the vessel beyond predetermined acceptable limits (e.g., 8° pitch and 12° roll from horizontal, maximum). In essence, the major dynamic forces which accomplish these objectives are:

Firstly, as one or both sides of the vessel progressively submerge deeper into the water, additional buoyancy tending to right the vessel is provided by the additional buoyancy of the struts for every inch of their emersion.

Secondly, should one or both sides of the vessel pitch or roll, to the extent where to one or both strakes come into contact with the water and begin to submerge, almost immediate and greatly increased reserve buoyancy is provided by the reserve buoyancy sponsons.

In addition to the increased reserve buoyancy provided by the struts and/or sponsons as they become progressively submerged, as aforesaid, and depending upon the speed of the vessel especially in head seas, the combination of downwardly angled inboard and outboard strake surfaces (especially when the downwardly angled strakes are arcuately joined to the vertical surfaces of the struts) operate to enhance the forces tending to right the vessel as soon as it commences to either pitch or roll. More specifically, as the vessel begins to pitch or roll, the descending pontoons displace water, a portion of which is caused to rush inwardly toward and vertically up the sides of the struts with an amount of force that is a function related to the speed of the vessel and rate of downward fall of the pontoons. This upwardly impinging force of water against the horizontal strake surfaces tends in itself to slow the descent. Further, the curved and downwardly angled strakes redirect this ascending water force downwardly creating a reverse thrust force that further tends to slow the speed of descent, and which said reverse thrust force in itself increases as the quantities of upwardly impinging water increase as the strakes get closer to the water surface and perhaps eventually submerge. This redirected jet action of water both slows and cushions the rate of fall of the vessel.

Other objects and advantages of the present invention will become apparent upon reading the following specification and referring to the accompanying drawings in which corresponding parts are similarly numbered in each of the several views, and wherein:

DETAILED DESCRIPTION OF THE PREFERRED EMBODIMENT

Figure 1:
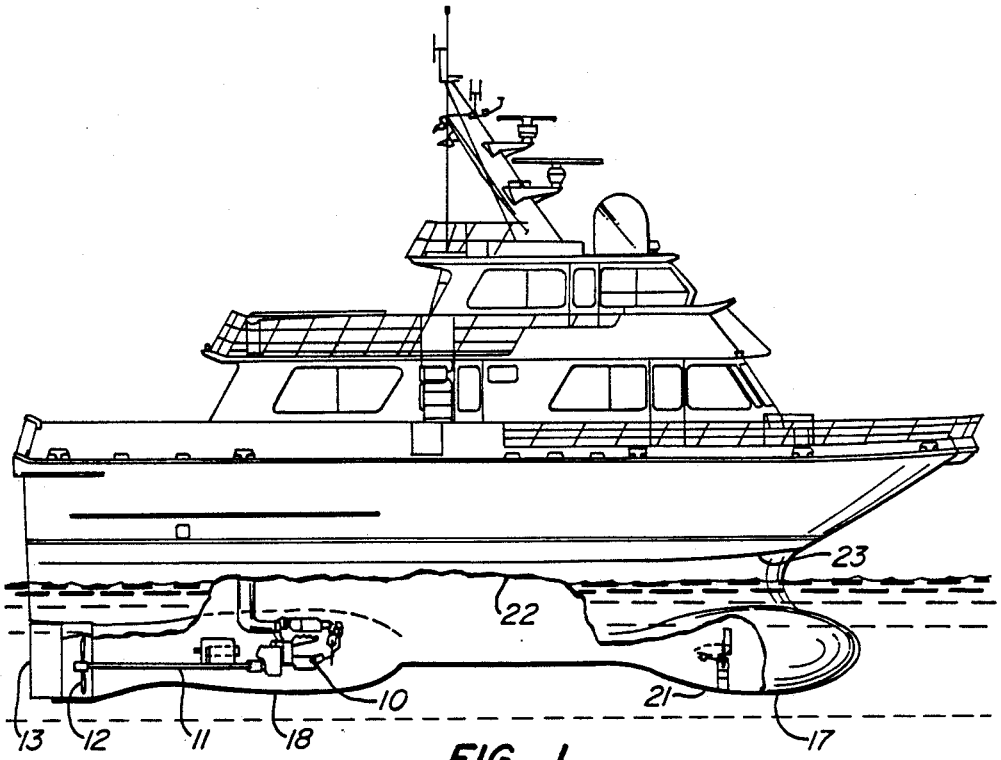
FIG. 1 is a side elevational view of a SWATH vessel embodying the present invention, with certain portions cut away showing the location of certain interior parts.

Referring more particularly to the drawings, the SWATH vessel embodying the present invention as illustrated is shown as comprising the major components of pontoons A, vertical supporting struts B, reserve buoyancy sponsons C, and an above-water superstructure indicated generally at D.

The underwater pontoons A are, of course, watertight, and they provide sufficient flotation or buoyancy to maintain the superstructure D at some desired predetermined distance spaced above the water line W when the vessel is at rest in the water. The pontoons A extend substantially the full length of the vessel and, in the embodiment shown, serve to house the main propulsion engines (such as diesel engines), indicated at 10, which can be operated by conventional state-of-the-art means to rotate either or both of drive shafts 11 and propellers 12 to propel and assist in steering the vessel. Associated with the pontoons A are twin rudders 13 and forward and aft horizontal stabilizers and canards, indicated at 14 and 16, respectively. The use of either fixed or manually or automatically controlled horizontal stabilizers in SWATH type vessels is already known and, as such, neither the stabilizers nor their manually and/or automatically controlled hydrofoil surfaces which may be provided are considered to be, per se, a part of the present invention.

In the embodiment shown, the two pontoons A are provided with enlarged fore and aft bulges 17 and 18, respectively. Bulge 18 is provided to more conveniently accommodate the main engine propulsion system 10 with its associated parts, and bulge 17 is provided to help equalize the fore and aft buoyancy of the underwater pontoons as related to the total buoyancy of the pontoons. Bulge 17 also may be used to house instrumentation and equipment, such as a vertical gyro 21, which may be provided as part of the automatic stabilizing system heretofore mentioned. The bulged pontoons are considered to be of substantial benefit and value in relatively small boats (i.e., less than 100 feet) where the main engines 10 cannot be conveniently fitted with sufficient work space for access into constant diameter pontoons, or when constant-diameter pontoons would provide excess buoyancy. Although it is highly desirable from a practical standpoint to mount the main drive engines in the pontoons (to provide a lower center of gravity and more utility above water deck, cabin or storage space, insofar as the scope of the present invention is concerned, it is immaterial whether the main engines 10 are placed in the underwater pontoons or in one other location above the pontoons, such as on the deck of the superstructure D. In the latter case, the rearwardly located engines would drive the propeller shaft 11 by conventional "Z" drive or other known mechanical linkage mechanisms mounted within the struts B,B'.

In the embodiment of the invention shown in the drawings, each of the struts B,B' comprises a single elongated vertical hydrodynamic strut extending substantially the full length of the vessel. The struts B,B' have many purposes and uses. For example, they may be used as access passages to the interior of the pontoons so that maintenance or other operations on the engines and equipment may be performed. More importantly, however, struts B,B' connect with and vertically support the reserve buoyancy sponsons C,C' and the entire superstructure D above the normal calm water line by a predetermined calculated distance. In the drawings, the SWATH vessel depicted represents an approximately 71' overall length vessel. By way of example, the top surfaces of the pontoons are submerged by approximately 24", and the wet deck 19 of the superstructure D is maintained vertically spaced above the calm water line W by approximately 8'.

Figure 2:
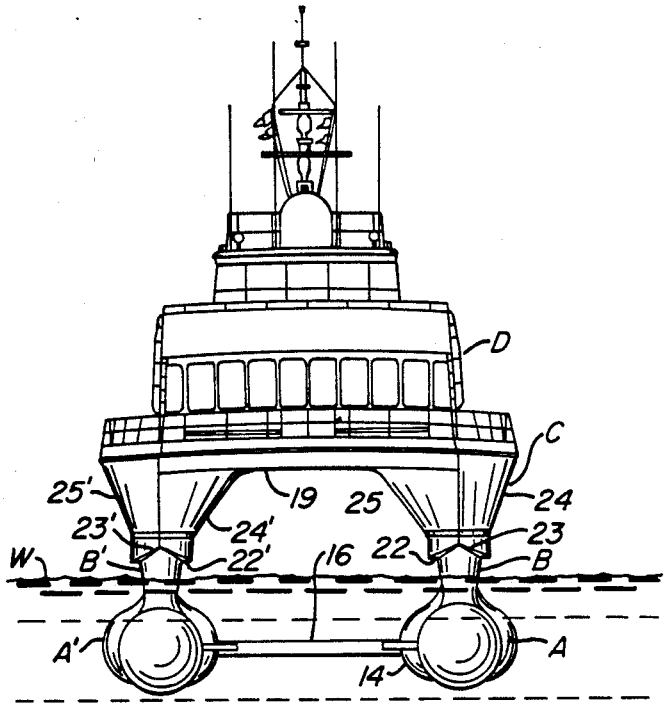
FIG. 2 is a front elevational view of a SWATH vessel embodying the present invention, with certain portions cut away showing the location of certain interior parts.
Figure 5:
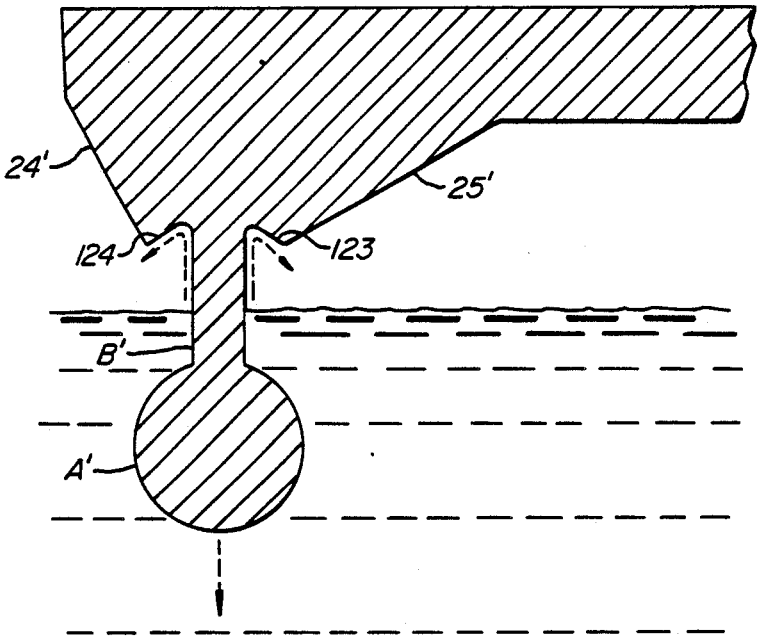
FIG. 5 is a fragmentary block schematic similar to FIG. 3, and further showing the curvatured and downwardly angled inboard and outboard surfaces of another embodiment of the strake.

Each reserve buoyancy sponson C,C' is formed generally in transverse cross-section in the shape of a truncated "V." The bottom surfaces of the sponsons each defines an elongated, continuous strake extending substantially the full length of the pontoons A,A' and the wet deck 19 of the superstructure. Each strake, as shown in the drawings, defines a long, sleek water contacting surface that, in transverse dimension, is relatively narrow compared with the overall width of the superstructure as measured in the plane of its wet deck surface 19. The strake defines surfaces which project laterally beyond either or both the inboard and outboard vertical plane of its associated strut, and preferably (as shown in the drawings) beyond both inboard and outboard strut sides. Typically, each strake may have an average width of more than 50% of the average transverse width of its associated strut. Furthermore, the forward ends of each strake may be contoured upwardly as shown in the areas indicated at 23,23' in FIGS. 1 and 2, and the bottom surfaces of the forward ends may slope downwardly, as shown in FIG. 2, to downwardly direct the spray caused by the struts as the vessel moves forwardly through the water. Further detailed explanation of the angularity and contour of the strake along its continuous horizontal length will be given in specific reference to the embodiment of the invention as depicted in FIG. 5 of the drawings. The relatively smooth horizontal, narrow and continuous elongated surface defined by each strake with its upwardly curved forward portions, in itself, forms a sort of water-ski surface which, when impacting the water, minimizes the initial jar that would otherwise occur should the waves directly impact against the large wet deck surface of the superstructure.

The total square inch area of each strake, and the angles at which the side walls 24,24' and 25,25' of the sponsons diverge upwardly and outwardly from the strakes 22,22', are calculated to provide an immediate and greatly increased buoyancy to the vessel upon either strake contacting and becoming immersed in water. For example, if the vessel is traveling down the back side of a wave and head-on into an oncoming wave, the oncoming wave will first contact and start to immerse the two strakes. The strakes substantially increase the waterplane area displaced by the vessel for providing almost instantaneously an immensely increased buoyancy to the vessel for preventing the bow of the vessel from plunging into the oncoming wave. As a result, the wet bottom and wet deck portions of the vessel literally rides over, rather than slamming against or ploughing into the oncoming waves virtually regardless of wave height or amplitude. Similarly, when external forces tend to roll or heel the vessel to one side or the other, the strake on the tilted or depressed side of the vessel will contact and become immersed in water, and the immediately increased buoyancy tends to force the vessel back to a horizontal position. Because of the additional volume provided by the vertically flared sponsons, buoyancy is further dramatically increased as the strakes are submersed deeper into the water. This is particularly useful in very rough seas where violent wave action is encountered. The forwardly flared sponsons also serve to cushion wave impact against the wet deck.

Figure 3:
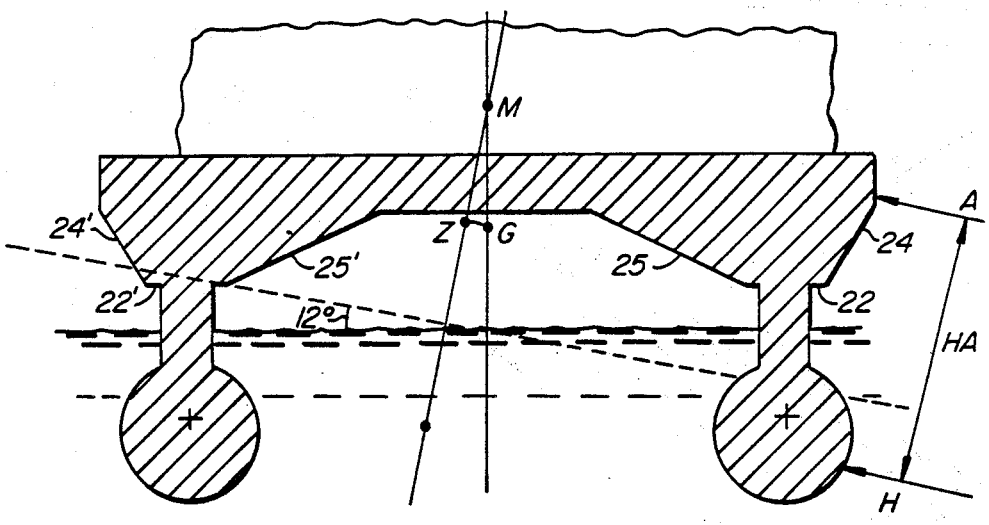
FIG. 3 is a block schematic showing a theoretical transverse cross-section of the lower pontoons, struts, reserve buoyancy sponsons, and superstructure wet-deck segments of the vessel shown in FIGS. 1 and 2.

In the preferred embodiments, the vessel is designed so that whenever it heels or rolls to one side or the other between approximately 8°–12° the strake 22 on the tilted or depressed side contacts and becomes immersed in the water, increases the waterplane area displaced by the vessel, and creates a substantial force for stabilizing or uprighting the vessel. See FIG. 3. Additionally, in the preferred embodiment, the strakes are designed to provide sufficient buoyancy at the contact angle to withstand the heeling force on the above-water area caused by a 60-knot sidewind. To accomplish this for an exemplary 12° heel angle, the improved SWATH vessel is initially designed in sufficient detail to accurately determine hull shape and placement of the payload. The weight, center of gravity (G), and Metacenter (M) of the vessel are then determined. Thereafter, hydrostatic characteristics of the vessel at 12° heel angle are determined. By measuring the displacement of the center of gravity at 12° heel, illustrated as GZ in FIG. 3, the righting moment RM at 12° heel may be calculated as GZ×displacement (weight) of the vessel in pounds.

Thereafter, the profile area, including the superstructure, that is projected above the waterline when the vessel is heeled 12° is calculated, and the centroid (A) of that area is determined. Similarly, the profile area that is projected below the waterline at 12° heel angle is calculated, and the centroid (H) of that area is determined. From this data, the vertical distance HA between the centroid A of the above-water area and the centroid H of the below-water area is readily obtained.

Since the heeling pressure at 60 knots' wind speed equals 19.10 lb./ft.$^2$, the heeling force (HF) is equal to the above-water profile area×19.10 lb./$^2$ft. The heeling moment (HM) at 12° heel then is equal to HA×HF. Once HM is calculated, the strake width and vessel characteristics are modified until RM is greater than or equal to HM. To guarantee competent design, the procedure is repeated for various ballast and load conditions to ensure that RM is greater than or equal to HM for all loading and ballasting conditions.

Figure 4:
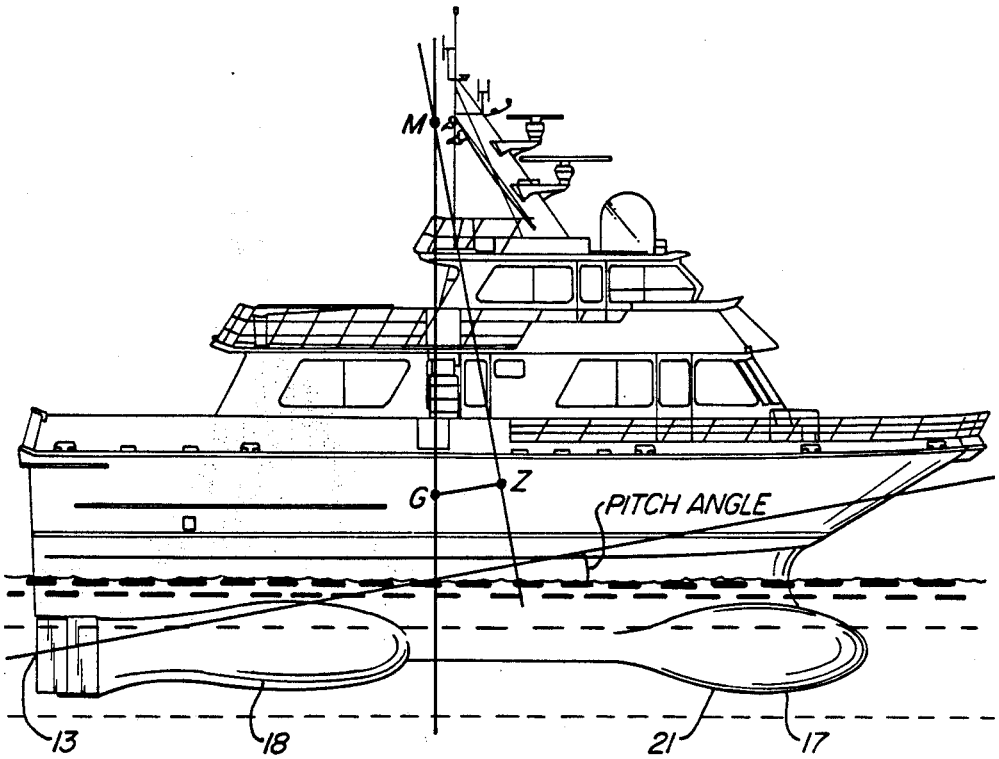
FIG. 4 is a side elevational view of a SWATH vessel embodying the present invention, showing a theoretical permissible pitch angle.

To design a vessel embodying the present invention for minimizing the angle of permissible pitch, we mathematically relate the permissible angle of pitch to the designed freeboard as measured, for example, at the bow. See FIG. 4. The freeboard in this case represents the distance between the calm waterline and bow weather deck. In this embodiment, the maximum pitch angle is determined by plotting a pitched waterline through a point located 75% of the distance of the freeboard. That is, for an 8-foot freeboard, the pitched waterline would pass through a point located 6 feet above the calm waterline at the bow. Once again, the righting moment RM is calculated by measuring the displacement of the center of gravity GZ at the desired pitch and then multiplying it by the displacement of the vessel. Presently, good practice indicates that GZ should be greater than or equal to S divided by 10, where S is equal to the strut length. For a given pitching moment PM, RM must be greater than or equal to PM. Thus, good practice indicates that GZ must be greater than or equal to S divided by 10, and the upper hull volume in the bow area (e.g., in the sponsons) is adjusted accordingly.

The techniques used for effecting the foregoing design, based on this disclosure, are well within the ordinary skill of a naval architect and are intended to conform generally to the current Stability Guidelines for SWATH vessels. However, in view of the flexible nature of the Guidelines and the fact that, in some instances, a designer need not or may not want to meet the current Guidelines, the foregoing design criteria may be modified accordingly to meet particular requirements.

From the foregoing, it is seen that the functional buoyancy per se, to the vessel (and without regard to other forces which contribute to righting the vessel when it starts to pitch or roll) is supplied by three major components when the vessel is underway and travelling in moderately rough seas. The primary flotation is provided by the buoyancy of the pontoons which, as above described, are sufficient to maintain the reserve buoyancy sponsons and superstructure above a calm water level. Additional buoyancy is provided by the struts so that, as the vessel begins to pitch or roll, a calculated and predetermined progressive degree of increased buoyancy is provided for every inch of additional immersion of either or both of the struts. Finally, greatly increased buoyancy is provided by the horizontally extending continuous strake defining the bottom areas of the sponsons and defining lateral projections 50%–100% greater than the cross-sectional width of the sponsons. In one preferred design of the vessel, the rate of increased buoyancy provided by the complete immersion of both struts, to a point just after the strakes of the reserve buoyancy sponsons contact the water, is augmented by approximately 150% to 200% of the rate of increased buoyancy provided by the struts alone. This is accomplished by increasing the total waterplane area displaced from 1.5 to 2 times the waterplane area displaced by the struts alone. Additionally, the design of the reserve sponsons is such that for every inch of additional submersion of the strake, the rate of increased buoyancy of the vessel is itself progressively increased. The amount of increase depends on the boat characteristics. In the disclosed embodiment, the rate of buoyancy increase is augmented by 103% for every inch the strakes are submersed.

Referring more particularly to FIG. 5, both the inboard and outboard surfaces 123 and 124, respectively, of the strake are shown inclined downwardly from the vertical sides of their associated strut. As depicted in FIG. 5, the angle is shown at about 20° from horizontal or 110° from the vertical sides of the strut. Further, the strake is preferably not joined or merged into the sides of the strut at a sharp angle, but rather the strake and associated strut surfaces are connected by a gentle curved or arcuate surface defining a substantial and smooth radius of curvature.

In head seas particularly, and depending also on vessel speed, the downwardly angled strake surfaces especially in combination with the curvatured joinder between strake and strut, operate to enhance the forces tending to right the vessel as it commences to either pitch or roll. These forces are in addition to the increased three major buoyancy or flotation forces previously described.

As the vessel begins to pitch or roll a portion of the water displaced by the submerged pontoons and struts is naturally propelled upwardly and away from the pontoons as the pontoons are pushed further under the water, resulting in sheets of water rushing inwardly toward and vertically up the sides of the struts with an amount of force that is a function related to the forward speed of the vessel and the speed of submergence or downward fall of the pontoons and struts deeper into the water. This upwardly impinging force of water against the horizontal strake surfaces tends in itself to slow the descent. Further, the curved and downwardly angled strake redirects this ascending water force downwardly, and indeed reverses increasing quantities of water as the strake gets closer to water's surface and eventually immersed. This constitutes a redirected jet action which both slows and cushions the rate of fall of the vessel.

It is possible to join the downwardly angled inboard and outboard surfaces of the strake to the struts at a sharply defined and non-curvatured angle. However, by making the juncture between the angled strake surfaces and strut curvatured as shown and described, a smoother and less disturbed and distorted upward and outward water flow is created. By making the juncture between the downwardly angled strake surfaces and the strut curvatured, the amount of stress load on both the shell plating at the strake's surface and on the transverse interior structural framing (not shown) of the hull due to the upwardly rushing force of water impinging or colliding onto the strakes bottom surface is minimized. In short, by curving the juncture, a significant part of the force of the upwardly impinging water is, is naturally and flowingly carried outwardly to thereby reduce the aforementioned stress loading on the shell plating and interior framing.

While the above is a reasonably complete description of a preferred embodiments of the present invention, various modifications may be employed. As already described in specific reference to FIG. 5, the bottom surfaces of the sponsons forming the strakes may be downwardly sloping along the entire length of the struts. In the more basic and broader context of the present invention, the strakes may be entirely flat and horizontal or have some other desired orientation, even upwardly sloping, as long as they provide the greatly increased rate of buoyancy desired. The width and surface area of the strakes also may vary accordingly. The body of the sponsons may have a constant transverse width, and need not be outwardly flared, to provide a constant rate of increased buoyancy as the sponsons are submerged. In fact, the sponson shape may vary according to design requirements, as long as they provide the accelerated rate of buoyancy increase or decrease, when desired, from the strake to the wet deck. Consequently, the scope of the invention should not be limited, except as properly described in the claims.

What is claimed is:

1. In a SWATH type vessel of the type having at least two submerged parallel pontoons, at least one vertical strut extending upwardly from each pontoon cooperatively supporting above the water line a superstructure, the combination comprising:

the combined buoyancy of the two pontoons being such as to support the superstructure above the water line even while the vessel is at rest; and at least one reserve buoyancy sponson supported by an associated strut and interposed between the underside of the superstructure and the top surface of a respective pontoon;

each sponson being vertically aligned above a respective pontoon and supported on its associated strut adjacent and above the water line while the vessel is at rest;

the said sponsons each having a relatively continuous narrow bottom surface extending substantially the length of its associated sponson and aligned with each other in substantially the same horizontal plane;

the said sponsons including said bottom surfaces thereof being shaped and configured to greatly increase the overall buoyancy of the vessel at a rapidly accelerated rate when, due to wave action, the lower extremities of the sponsons become increasingly immersed beneath the water line.

2. The combination of claim 1 wherein each sponson in transverse cross-section defines generally a truncated V-shape.

3. The combination of claim 2 wherein the truncation forming the bottom surface of each sponson defines a horizontally extending strake having an average width of more than 50% of the average transverse width of its associated strut, so as to provide near instantaneous significant increased buoyancy to the vessel upon the truncated bottom surfaces of the sponsons and their respective immediate upwardly diverging conical side surfaces becoming immersed beneath the surface of a wave.

4. The combination of claim 3 wherein the height above the water line of each strake is such that at any angle roll to port or starboard at or exceeding 12°, the strake on the downside will contact the water and result in substantially instantaneous increased buoyancy tending to upright the vessel.

5. A SWATH-type vessel comprising:

a superstructure;

first and second pontoons disposed beneath the superstructure;

at least one strut disposed between each pontoon and the superstructure for supporting the superstructure, so that the combined buoyancy of the first and second pontoons and the struts is sufficient to support the superstructure spaced apart from a waterline by a first prescribed distance when the vessel is disposed in calm water; and first buoyancy rate increasing means, associated with each strut extending in a common horizontal plane substantially the length of each associated strut and disposed between the superstructure and the pontoon, for increasing the rate of buoyancy increase as the superstructure progressively moves toward the waterline.

6. The vessel according to claim 5 wherein the first buoyancy rate increasing means increases the rate of buoyancy increase when the superstructure is spaced apart from the waterline by a second prescribed distance, the second distance being less than the first distance.

7. The vessel according to claim 6 wherein the first buoyancy rate increasing means comprises first waterplane area increasing means for increasing the waterplane area displaced by the vessel when the superstructure is spaced apart from the waterline by the second distance.

8. The vessel according to claim 7 wherein the first buoyancy rate increasing means comprises a substantially hollow sponson disposed between each strut and the superstructure.

9. The vessel according to claim 8 wherein each sponson includes a bottom surface extending outwardly from its associated strut at the second distance from the superstructure.

10. The vessel according to claim 9 wherein each bottom surface extends symmetrically outwardly from the strut.

11. The vessel according to claim 10 wherein each sponson extends fore and aft of the vessel along substantially the entire length of its associated strut.

12. The vessel according to claim 11 wherein the bottom surface of each sponson extends along substantially the entire length of the sponson.

13. The vessel according to claim 12 wherein the bottom surface of each sponson extends downwardly.

14. The vessel according to claim 12 wherein the bottom surface of each sponson extends generally perpendicularly from the strut.

15. The vessel according to claim 12 wherein the forward bottom surface of each sponson extends upwardly.

16. The vessel according to claim 12 wherein the bottom surface of each sponson extends substantially horizontally.

17. The vessel according to claim 12 wherein each sponson is disposed adjacent to the superstructure.

18. The vessel according to claim 17 wherein each sponson has a substantially constant transverse width.

19. The vessel according to claim 17 wherein each sponson includes second buoyancy rate increasing means for progressively increasing the waterplane area displaced by the sponson as the sponson is progressively submerged.

20. The vessel according to claim 17 wherein each sponson has a side which tapers outwardly for increasing the waterplane area displaced by the sponson as the sponson is progressively submerged.

21. The vessel according to claim 9 wherein the first buoyancy rate increasing means substantially prevents the vessel from rolling more than a first prescribed angle from horizontal.

22. The vessel according to claim 21 wherein the first buoyancy rate increasing means substantially prevents the vessel from pitching more than a second prescribed angle from horizontal.

23. The vessel according to claim 9 wherein the bottom surface of each sponson is located so that, when the vessel is disposed at a first prescribed angle to the waterline, the bottom surface of a sponson contacts the waterline.

24. The vessel according to claim 23 wherein the first prescribed angle is from approximately 8° to approximately 12°.

25. The vessel according to claim 24 wherein the first prescribed angle is a roll angle.

26. The vessel according to claim 25 wherein a portion of each sponson in close proximity to the bow of the vessel has sufficient volume to substantially prevent the vessel from pitching more than a second prescribed angle from horizontal.

27. In a SWATH-type vessel of the type having a superstructure, first and second submerged pontoons, and a strut disposed between each pontoon and the superstructure for coupling the pontoons to the superstructure, wherein the combined buoyancy of the struts and the pontoons are sufficient to support the superstructure spaced apart from a water surface, the improvement comprising:

a first sponson disposed between the superstructure and the pontoons, the sponson including a first elongate smooth horizontal bottom surface for increasing the waterplane area displaced by the vessel and for increasing the buoyancy of the vessel when the bottom surface contacts the water surface.

28. The vessel according to claim 27 wherein the first bottom surface defines a strake having surfaces projecting both inboard and outboard from the vertical sides of its associated strut.

29. The vessel according to claim 28 wherein at least some areas of the lateral projecting surfaces of the strake are downwardly angled from the vertical sides of its associated strut.

30. The vessel according to claim 27 wherein the first sponson is substantially hollow.

31. The vessel according to claim 30 wherein the first sponson is intended to be located adjacent to the superstructure.

32. The vessel according to claim 31 wherein the first sponson is intended to be disposed between a strut and the superstructure.

33. The vessel according to claim 32 wherein the first bottom surface extends symmetrically from the strut.

34. The vessel according to claim 32 further comprising:

a second sponson disposed between the superstructure and the pontoons, the sponson including a second bottom surface for increasing the waterplane area displaced by the vessel and for increasing the buoyancy of the vessel when the bottom surface contacts the water surface.

35. The vessel according to claim 34 wherein the second sponson is substantially hollow.

36. The vessel according to claim 35 wherein the second sponson is intended to be located adjacent to the superstructure.

37. The vessel according to claim 36 wherein the first sponson is intended to be disposed between the first pontoon and the superstructure, and the second sponson is intended to be disposed between the second pontoon and the superstructure.

38. The vessel according to claim 37 wherein the first and second bottom surfaces are located so that at least one of the first and second bottom surfaces contacts the water surface when the vessel rolls by a prescribed amount.

39. The vessel according to claim 37 wherein the first and second bottom surfaces are located so that at least one of the first and second bottom surfaces contacts the water surface when the vessel is disposed at an angle from approximately 8°–12° from horizontal.

40. The vessel according to claim 37 wherein the first and second bottom surfaces are substantially flat.

41. The vessel according to claim 40 wherein the first and second bottom surfaces extend downwardly.

42. The vessel according to claim 40 wherein the first and second bottom surfaces are substantially horizontal.

43. The vessel according to claim 40 wherein the first and second bottom surfaces extend upwardly.

44. The vessel according to claim 41 wherein the first sponson has an outer surface extending from the bottom surface toward the superstructure.

45. The vessel according to claim 44 wherein the outer surface tapers outwardly from the bottom surface to the superstructure.

46. The combination of claim 1 and wherein the said relative narrow continuous bottom surface of each sponson defines a horizontal strake having laterally projecting surfaces extending at least beyond the outboard vertical plane of its associated strut.

47. The combination of claim 46 and wherein at least one of said laterally projecting surfaces is downwardly angled from the vertical plane of its associated strut.

48. The combination of claim 47 and wherein the juncture which joins each downwardly angled projecting surface to its associated strut is arcuately curved.

49. The combination of claim 1 and wherein the said relative narrow continuous bottom surface of each sponson defines a horizontal strake having laterally projecting surfaces extending at least beyond the inboard vertical plane of its associated strut.

50. The combination of claim 49 and wherein at least one of said laterally projecting surfaces is downwardly angled from the vertical plane of its associated strut.

51. The combination of claim 50 and wherein the juncture which joins each downwardly angled projecting surface to its associated strut is arcuately curved.

52. The combination of claim 1 and wherein the said relative narrow continuous bottom surface of each sponson defines a horizontal strake having laterally projecting surfaces extending beyond both the inboard and outboard vertical plane of its associated strut.

53. The combination of claim 52 and wherein at least one of said laterally projecting surfaces is downwardly angled from the vertical plane of its associated strut.

54. The combination of claim 53 and wherein the juncture which joins each downwardly angled projecting surface to its associated strut is arcuately curved.

* * * * *